US009469453B2

(12) United States Patent
Walter et al.

(10) Patent No.: US 9,469,453 B2
(45) Date of Patent: Oct. 18, 2016

(54) DEVICE FOR DISPENSING A FLOWABLE MATERIAL

(71) Applicant: 3M INNOVATIVE PROPERTIES COMPANY, St. Paul, MN (US)

(72) Inventors: Alexander Walter, Puergen (DE); Marc Peuker, Schondorf (DE); Bruce R. Broyles, Oakdale, MN (US); Andreas J. Boehm, Reichling (DE)

(73) Assignee: 3M INNOVATIVE PROPERTIES COMPANY, Saint Paul, MN (US)

( * ) Notice: Subject to any disclaimer, the term of this patent is extended or adjusted under 35 U.S.C. 154(b) by 0 days.

(21) Appl. No.: 14/810,780

(22) Filed: Jul. 28, 2015

(65) Prior Publication Data

US 2015/0329252 A1 Nov. 19, 2015

Related U.S. Application Data

(63) Continuation of application No. 13/505,612, filed as application No. PCT/US2010/055205 on Nov. 3, 2010, now Pat. No. 9,120,606.

(60) Provisional application No. 61/258,333, filed on Nov. 5, 2009.

(51) Int. Cl.

| | |
|---|---|
| ***B67B 1/00*** | (2006.01) |
| ***B65D 50/04*** | (2006.01) |
| ***B65D 47/08*** | (2006.01) |

(52) U.S. Cl.

CPC ..... *B65D 50/046* (2013.01); *B65D 47/0809* (2013.01); *B65D 47/0885* (2013.01); *B65D 2251/1058* (2013.01)

(58) Field of Classification Search

CPC ..... B65D 2251/1016; B65D 2251/105; B65D 2251/1058; B65D 2251/1075; B65D 50/046; B65D 47/0809; B65D 47/0885

USPC ..... 222/153.14, 556, 557, 546, 568, 563; 215/216, 224, 235–237; 220/281

See application file for complete search history.

(56) References Cited

U.S. PATENT DOCUMENTS

| | | | |
|---|---|---|---|
| 3,103,691 | A | 9/1963 | Stull |
| 3,770,153 | A | 11/1973 | Gach |

(Continued)

FOREIGN PATENT DOCUMENTS

| | | |
|---|---|---|
| DE | 2435337 | 2/1976 |
| DE | 20304496 | 6/2003 |

(Continued)

OTHER PUBLICATIONS

International Search Report for PCT/US2010/055205 mailed Jan. 3, 2011.

(Continued)

*Primary Examiner* — J. Casimer Jacyna
*Assistant Examiner* — Benjamin R Shaw

(57) ABSTRACT

A dispenser comprising a body with an outlet, and a closure for the outlet. The closure and the body are pivotally movable relative to each other between an open position in which the outlet is open and a closed position in which the closure closes the outlet. The closure and the body are adapted for locking engagement with each another in the closed position. The closure has a locking member for locking and unlocking the closure and the body in the closed position. A force applied on the locking member for unlocking urges the closure toward the open position. The dispenser preferably facilitates the application of a material to be dispensed to a desired location.

23 Claims, 4 Drawing Sheets

(56) References Cited

U.S. PATENT DOCUMENTS

| | | | | | |
|---|---|---|---|---|---|
| 4,022,352 | A * | 5/1977 | Pehr | B65D 47/0838 | 215/211 |
| 4,170,315 | A * | 10/1979 | Dubach | B65D 47/0814 | 220/281 |
| 4,236,653 | A * | 12/1980 | Gach | B65D 47/0838 | 222/153.14 |
| 4,403,712 | A | 9/1983 | Wiesinger | | |
| 4,533,058 | A * | 8/1985 | Uhlig | B65D 47/0838 | 215/211 |
| 4,790,442 | A | 12/1988 | Gach | | |
| 4,809,874 | A | 3/1989 | Pehr | | |
| 5,207,657 | A * | 5/1993 | Gibilisco | A61M 35/003 | 215/216 |
| 5,246,145 | A | 9/1993 | Leoncavallo | | |
| 5,328,058 | A * | 7/1994 | Leoncavallo | B65D 47/0885 | 215/216 |
| 5,996,859 | A * | 12/1999 | Beck | B65D 47/0809 | 215/237 |
| 6,691,901 | B2 | 2/2004 | Parve | | |
| 7,325,708 | B2 * | 2/2008 | Barber | A61F 9/0026 | 222/420 |
| 7,404,495 | B2 * | 7/2008 | Keung | B65D 47/0804 | 215/216 |
| 9,120,606 | B2 * | 9/2015 | Walter | | |
| 2004/0238540 | A1 * | 12/2004 | Jackel | B65D 47/0804 | 220/259.1 |
| 2006/0037972 | A1 * | 2/2006 | Leiner | A61C 5/062 | 222/212 |
| 2006/0157516 | A1 | 7/2006 | Barber | | |
| 2006/0163188 | A1 | 7/2006 | Lagler | | |
| 2006/0213934 | A1 * | 9/2006 | Uytterhaeghe | B65D 47/0809 | 222/546 |
| 2007/0075030 | A1 | 4/2007 | Delli Venneri | | |
| 2007/0138123 | A1 * | 6/2007 | Blomdahl | B65D 47/0809 | 215/235 |
| 2009/0026228 | A1 * | 1/2009 | Bressler | B65D 47/18 | 222/420 |

FOREIGN PATENT DOCUMENTS

| | | |
|---|---|---|
| GB | 1484517 | 9/1977 |
| JP | 2005-104527 | 4/2005 |

OTHER PUBLICATIONS

Extended European Search Report dated Nov. 6, 2013.

* cited by examiner

DEVICE FOR DISPENSING A FLOWABLE MATERIAL

RELATED APPLICATION DATA

This is a continuation of U.S. patent application Ser. No. 13/505,612, filed May 2, 2012 (allowed), which is a 35 USC §371 national stage filing of PCT Application No. PCT/US2010/055205, filed Nov. 3, 2010, which claims the benefit of U.S. Provisional Application No. 61/258,333, filed Nov. 5, 2009, the disclosures of which are incorporated herein by reference in their entirety.

FIELD OF THE INVENTION

The invention relates to a device for dispensing a flowable material, in particular a dental material.

BACKGROUND ART

Dental materials are often provided in packages that are designed to facilitate preparation and/or application of the materials in a dentist's practice. Flowable dental materials are for example often provided in dropper bottles which allow the material to be dispensed in droplets so that a desired amount can be easily metered by a user.

For example U.S. Pat. No. 5,246,145 discloses a dropper bottle assembly with a dispensing closure which can be secured to the bottle. The dispensing closure has a dropper spout and a separate cap for closing the spout. The cap is pivotally fixed at the dispensing closure for opening and reclosing the spout. The dropper bottle further has a locking mechanism for locking the cap closed on the spout.

Although a variety of different packages are used in dentistry that may provide advantages in certain respects there is still a need for a package that is easy to use, relatively inexpensive, and provides relatively long shelf life for the material contained. Further there is a need particularly for a dropper bottle which can be manufactured and/or filled using existing equipment, but which provides certain handling advantages for a user and which is available at a relatively low price.

SUMMARY OF THE INVENTION

The invention relates to a dispenser which comprises a body with an outlet, and a closure for the outlet. The closure is pivotally interconnected at the body by a first pivotal interconnection such that the closure is movable relative to the body between an open position in which the outlet is open and a closed position in which the closure closes the outlet. Further the closure and the body are adapted for locking engagement with each other in at least the closed position. The closure has a locking member that is movable relative to the closure between a lock position and an unlock position. The lock position allows for locking the closure with the body in the closed position, whereas the unlock position provides for unlocking the closure for movement from the closed toward the open position. Relative to the lock position the unlock position thus preferably enables a movement of the closure and the body relative to one another from the closed position toward the open position. The locking member has an actuator for moving the locking member between the lock and the unlock position. Further the actuator is arranged relative to the first pivotal interconnection such that a force applied on the actuator relative to the body for moving the locking member toward the unlock position also urges the closure toward the open position. Preferably applying the force on the actuator causes a torque between the body and the closure which has a rotational direction suitable to urge the closure and the body toward the open position.

The invention is advantageous in that it may provide for a facilitated operation by a user relative to devices of the prior art. In particular the invention may allow a single handed operation of the dispenser, for example unlocking and opening of the dispenser by a single move in substantially one direction. The invention may further provide for relative low forces required to unlock the closure from the body. The invention may further be advantageous in that it may provide for a relatively tight sealing of the outlet. Therefore a material to be dispensed may be prevented from escaping through the outlet in the closed position of the dispenser. Further the invention may provide for securing the closure at the device such that it is not lost in the open position of the dispenser. This may help to achieve a relatively long shelf life of the material to be dispensed because a user can easily reclose the dispenser. The invention may also allow for a relatively inexpensive manufacturing. In particular the dispenser may be formed as a single piece or at least at a minimized amount of pieces, and therefore may help minimizing costs, for example due to elimination of assembly steps.

In one embodiment the locking member is resiliently urged toward the lock position. For example the dispenser may be formed (for example molded from plastic) with the locking member in the lock position (for example with the closure and the body in the open position). In this example the dispenser may be made of a material providing for a certain natural elasticity that is sufficient to reset the locking member from outside the lock position. Therefore an additional resilient element, like a spring, may be saved. The locking member may for example form one piece with the closure.

In another embodiment the locking member has a first retainer and the body has a second retainer. The first and second retainers are preferably adapted for engagement with each other for locking the closure and the body in the closed position. Thus in the closed position of the dispenser the first and second retainers may be adapted to prevent the closure from moving toward the open position. Further the dispenser may be configured such that moving the locking member toward the unlock position—in the closed position of the dispenser—causes the first and second retainers to disengage. Thus a movement of the closure from the closed toward the open position may be enabled.

In one embodiment the locking member is pivotally interconnected to the closure by a second pivotal interconnection. Therefore the first pivotal interconnection may provide for relative rotatability between the closure and the body, whereas the second pivotal interconnection may provide for relative rotatability between the locking member and the closure. Thus, for example in use of the dispenser, the closure may be rotatable relative to the body in a first rotational direction for moving the closure from the closed toward the open position. Further the locking member may be rotatable relative to the closure in a second rotational direction for moving the locking member from the lock position toward the unlock position. Preferably the first and second rotational directions generally correspond to each other. Therefore operating the locking member for unlocking the closure and the body from one another preferably also causes the closure and the body to be urged toward the open position. This may be particularly advantageous in use of the device in dentistry because the dispenser may be operated by a single hand only. For example a dentist when treating a patient may need one hand to hold a dental instrument, like a mirror or a probe, so that the dentist may have only one hand available for dispensing a material required for the treatment into the patient's mouth. The dispenser according to the invention may allow the dentist to open and reclose the device, as well as to dispense a material by use of a single hand only. Therefore the dispenser may be relatively convenient to use, and may particularly in dental use provide for saving time in the treatment of a patient.

In one embodiment the first and second pivotal interconnections provide for rotatability about a first rotation axis and a second rotation axis, respectively. The first and second rotation axes may be spaced apart from one another and may extend generally parallel to each other.

The second pivotal interconnection between the locking member and the closure may form a first pivot for the locking member. For example the locking member may have a free first end comprising the actuator and an opposite second end which is connected with the closure. The connection between the locking member and the closure may for example form an elastic pivot allowing the locking member to be moved, whereas the locking member itself may be substantially rigid. The locking member may further comprise a support that is arranged to abut the closure when the locking member is operated from the lock position toward the unlock position. The support may be spaced from the closure in the lock position. The support may be arranged at the locking member between the first pivot and the actuator. Thus the support may form a second pivot for the locking member. For example the locking member, moved toward the unlock position, may move around the first pivot until the support abuts the closure. Once the support abuts the closure the locking member may move around the second pivot. Therefore a movement of the locking member may have an initial stroke in which the support is spaced from the closure and a subsequent stroke in which the support abuts the closure. As described in more detail below, the initial stroke may provide for mainly relieving a pretension between the closure and the body (for example used for tightly holding the closure on the outlet), whereas the subsequent stroke may provide for relatively fast disengaging the first and second retainers. Thus a relatively fast opening of the dispenser at relatively low operating forces may be achieved. This further may provide for a relative convenient operation of the device.

In another embodiment the first and or second retainers may be hook shaped. In this case disengaging the first and second retainers may cause the closure to be urged toward the closed position while the retainers are moved relative to one another for unlocking. This may provide for a more secure locking when the retainers are engaged.

In one embodiment the dispenser has an inlet for receiving material to be dispensed from a container. The inlet may be arranged opposite of the outlet. The inlet may for example allow for connecting the outlet to a container that is adapted to store a material to be dispensed. The dispenser may have a longitudinal axis. The longitudinal axis may extend through the inlet and the outlet (for example through about the centers of the inlet and outlet). Further the longitudinal axis may be arranged between the first and second rotational axes. The longitudinal axis may further extend generally perpendicular to the first and second rotational axes.

In one embodiment the locking member extends generally parallel to this longitudinal axis. The actuator of the locking member may form the free first end of the locking member. In this case the locking member may be oriented such that the actuator extends toward a direction substantially corresponding to a direction from the inlet toward the outlet.

In another embodiment the first pivotal interconnection may be a hinge. The hinge may be arranged adjacent a first side of the body, whereas the locking engagement may be provided by a lock adjacent an opposite second side of the body. The outlet may be provided between the first and second sides. The closure in the closed position may extend between the first and second sides and thereby cover the outlet. Thus the closure may be adapted such that the closure in the closed position covers the outlet between the first and second sides.

In a further embodiment the hinge is adapted to automatically urge the body and the closure from an intermediate position between the open and closed position toward the open or closed position. Therefore a bistable hinge may be formed. The bistable hinge may automatically position toward either the open or the closed position but may not remain in intermediate positions. The hinge may further be formed by a living hinge forming one piece with the closure and the body. This may help minimizing costs because the living hinge may be formed along with the closure and the body in a single manufacturing step. The hinge may further be molded by two-step injection molding with the closure and the body. Therefore the hinge may still form one piece with the closure and the body, but may be formed of a different material than the closure and the body.

In one embodiment the closure is biased onto the outlet in the closed position. The bias or pretension of the closure onto the outlet may be maintained by the engaged retainers in the closed position of the dispenser. The pretension may for example be built up by a user forcing the closure toward the closed position.

In another embodiment the closure comprises a seal for sealing the outlet in the closed position. Therefore the seal may provide for tightly sealing the outlet to prevent a material to be dispensed from passing the outlet. The seal may be a rubber seal for example. Further the seal may be made from a soft thermoplastic material, or a thermoplastic elastomer. Thus the invention may provide for a maximized shelf life of materials contained in the container. Further the dispenser in the closed position may be storable with the closure down and the container up without material leaking from the dispenser.

In one embodiment the dispenser comprises a container for receiving the material to be dispensed. The container may for example comprise a coupling for mating with a corresponding coupling of the body of the dispenser. The coupling(s) may comprise a thread, for example, or any other structure allowing for retaining the container to the body.

In a further embodiment the actuator and the container are arranged relative to each other such that the container can be clasped by a user's hand with the thumb placed on the actuator, and such that the actuator can be moved toward the unlock position by moving the thumb in a direction away from the user's hand, and wherein, after reaching the unlock position, the closure can be moved toward the open position by further moving the thumb in generally the same direction away from the hand.

In one embodiment the container forms a bottle. The bottle may have a transparent container wall. The transparent container wall may comprise a light filter, for example a light filter which blocks blue light. Blue light may for example interact with photo initiators in a material contained in the container which may cause the material to harden or alter otherwise. Therefore blocking of blue light may prevent the material from premature alteration, and thus may help maximizing the shelf life of the material.

The container may further comprise the material to be dispensed. The material may for example be a dental adhesive.

In another embodiment the dispenser may comprise a dropper nozzle forming the outlet. The dropper nozzle may provide for a precise dispensation of the material.

DETAILED DESCRIPTION OF THE INVENTION

Figure 1:
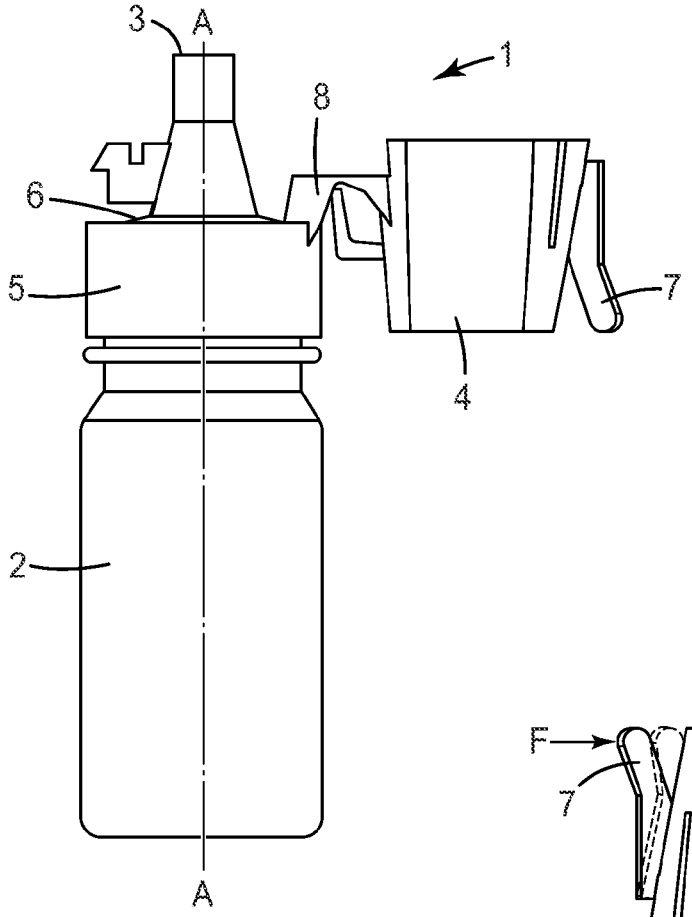
FIG. 1 is a side view of a device in an open position according to an embodiment of the invention.

FIG. 1 shows a device 1 having a dispenser 6 with an outlet 3, and a closure 4 for closing the outlet 3. The device 1 is shown in an open position in which the outlet 3 is open. In the open position the device 1 may be used to dispense a material from the outlet 3 to a desired place.

Figure 2:
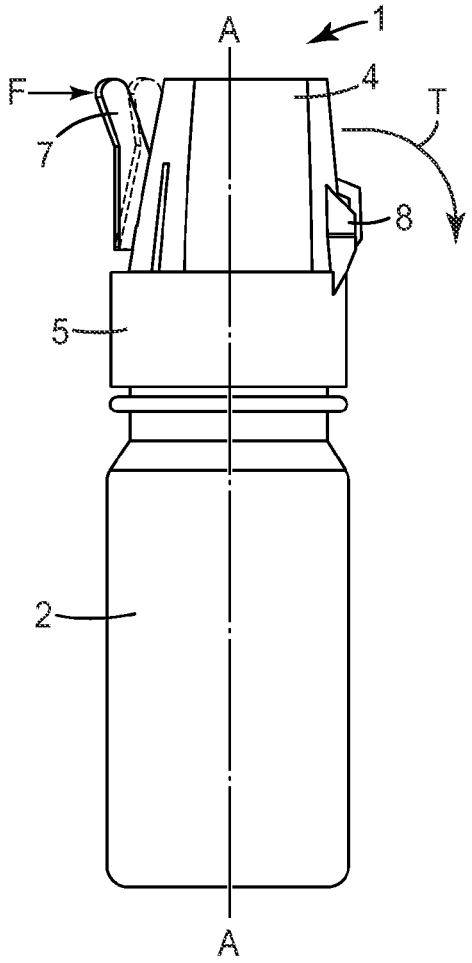
FIG. 2 is a side view of a device in a closed position according to an embodiment of the invention.

The dispenser 6 has a closure 4 and a body 5 which are pivotally interconnected. Thus the closure 4 and the body 5 are movable or rotatable relative to each other. In the example the interconnection is formed by a hinge 8. Therefore the closure 4 can be moved relative to the body 5 toward a closed position in which the outlet 3 is closed as shown in FIG. 2. In the closed position the outlet is preferably sealed by the closure 4 so that material to be dispensed is prevented from passing the outlet.

The device 1 as shown in FIGS. 1 and 2 has a longitudinal dimension generally along longitudinal axis A. The longitudinal dimension may correspond to a dimension along which material is displaced toward the outlet for dispensing. The skilled person will recognize that the longitudinal dimension is not necessarily straight as illustrated, but may be curved or have curved sections. The closure 4 is rotatable relative to the body 5 laterally to the longitudinal axis A of the device 1. For example the closure 4 may be rotatable substantially about a first rotation axis that is arranged offset from the longitudinal axis A and generally perpendicular to the longitudinal axis A. The configuration shown allows the closure 4 and the outlet 3 to be moved sufficiently away from one another to reduce the probability of the closure to get contaminated with material dispensed during use of the device 1. Further the closure 4 may be prevented from being lost because it remains attached to the body 5 while the closure 4 and the body 5 are moved relative to one another.

The closure 4 and the body 5 are further adapted for locking engagement with each other in at least the closed position. Thus the closure is preferably retained in the closed position which may be advantageous for storage and/or transport of the device 1. The closure 4 has a locking member 7. The locking member 7 preferably allows for unlocking of the closure so that it can be moved toward the open position, for example by a user. Accordingly the locking member 7 may per default be positioned in the lock position. Therefore the locking member 7 is movable between a lock position and a unlock position. FIG. 2 shows the device with the locking member 7 locking the closure 4 with the body 5 in the closed position. The locking member 7 from the position shown is movable toward the unlock position (indicated by dashed lines) providing for unlocking the closure and the body. In the unlock position a rotation of the closure and the body from the closed toward the open position is enabled. The locking member 7 may further be limited in movement between the lock and the unlock position. In particular the locking member 7 may be restrained such that it cannot be moved from the lock position further in a direction from the unlock toward the lock position (in the Figure toward the left). This may be achieved for example by a flexible strap arranged between the locking member and the closure. The strap may deflect when the locking member is moved from the lock toward the unlock position, but may be substantially unexpandable. Thereby a user may be prevented from operating the locking member in an undesired direction.

Moving the locking member toward the unlock position can be caused by an actuation force F applied on the locking member as indicated in FIG. 2. The actuation force F is preferably applied relative to the body 5. For example the body may be retained while the force is applied to the locking member 7. A suitable direction of the actuation force for moving the locking member from the lock position toward the unlock position is predetermined by the arrangement (for example orientation and shape) of the locking member, which is described in more detail below. The direction of the actuation force is preferably predetermined such that it is oriented laterally to the longitudinal axis A. Further the direction of the actuation force may be predetermined along a line which is generally transverse to the first rotation axis, for example provided by the hinge, but not intersecting with the first rotation axis. Therefore an actuation of the locking member preferably also causes a torque between the body 5 and the closure 4 around the first rotation axis. Thus when the device is retained at the body 5 the actuation force F applied on the locking member causes a torque T which urges the closure toward the open position. Therefore if the actuation force F is maintained until the unlock position is reached the closure may unlock and then rotate toward the open position. In this way releasing the closure and the body from one another as well as moving the closure and the body toward the open position may be performed in a single operational step. This may facilitate the operation of the device, and in particular may enable a single hand operation for opening the device as further illustrated in FIG. 3.

The device 1 further has a container 2. In the example shown the container 2 is in the form of a bottle. The bottle may be flexible so that it can be squeezed by a user for dispensing material. The container 2 preferably has an opening which is covered by the dispenser 6. The opening may be sufficiently large to allow for a convenient filling of a material into the container during manufacturing. On the other hand the dispenser 6 may allow for controlled dispensation of the material when the device is used. The container 2 may further be used for holding the device 1. Therefore the container 2 may allow a user to conveniently hold the device 1 at the container 2 for actuating the locking member and for opening the closure 4.

Figure 3:
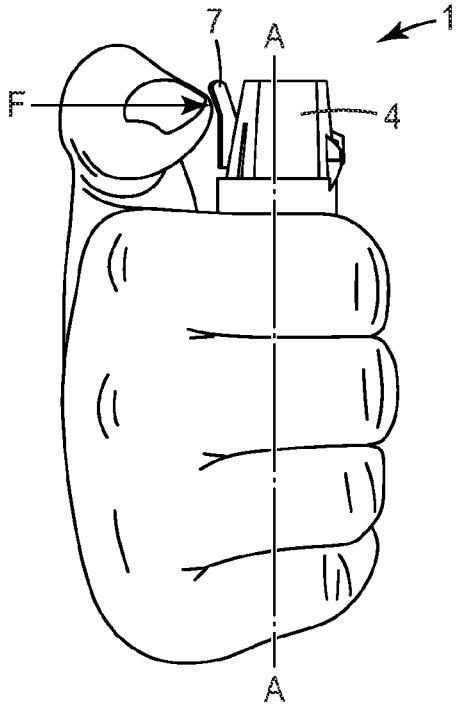
FIG. 3 is a perspective view of a device according to an embodiment of the invention held by a user.

FIG. 3 shows the device 1 held in a user's hand. The user holds the device 1 at the container (not visible) with the locking member 7 oriented toward the user's thumb. The shape and the position of the locking member relative to the remainder of the device are such that an actuation of the locking member is enabled in a direction generally laterally to the longitudinal dimension A of the device. Thus the device by its configuration predetermines the orientation of the actuation force F to provide for the torque that urges the closure 4 toward the open position.

Figure 4:
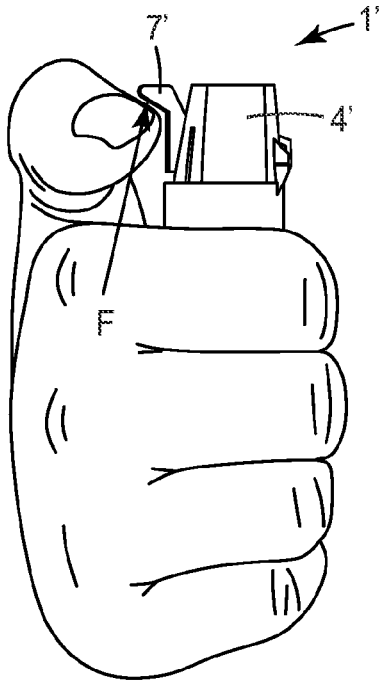
FIG. 4 is a perspective view of a further device according to an embodiment of the invention held by a user.

As illustrated in FIG. 4 the locking member 7' of the device 1' may have a different shape which likewise provides for a torque suitable for urging the closure 4' toward the open position. The skilled person will be able to provide further shapes and/or positions of a locking member which provide a similar or equivalent effect, and which are included in the scope of the present invention.

Figure 5:
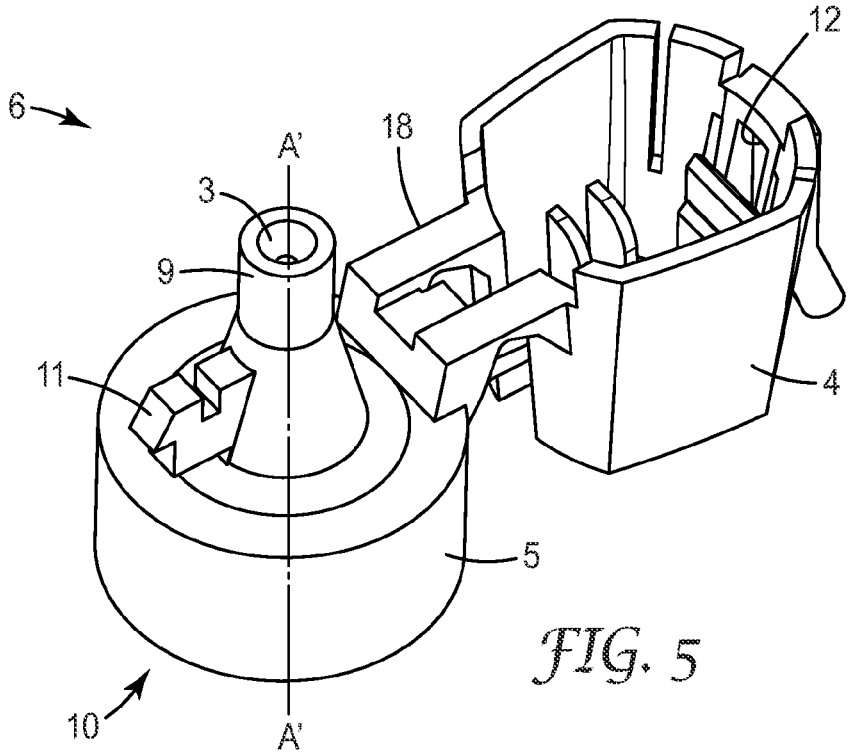
FIG. 5 is a perspective view of a dispenser according to an embodiment of the invention.

FIG. 5 is a perspective view of the dispenser 6. As illustrated the dispenser 6 has a body 5 and a closure 4 that form one piece. In the example the body 5 and the closure 4 are interconnected via a living hinge 18. The dispenser 6 further has a dropper nozzle 9 which comprises the outlet 3. The dropper nozzle 9 protrudes from the body 5. The body 5 further has an inlet 10 (not visible) which is preferably adapted for connecting with an outlet of a container (not shown). In the example the body 5 of the dispenser 6 forms a cap for receiving an end of the container. The cap of the body may for example comprise an internal thread for engaging a corresponding external thread of the container. The skilled person will recognize other configurations allowing for coupling of the dispenser 6 with the container, like for example a snap coupling, a glued coupling or a coupling in which the internal thread is arranged at the container and the external thread is arranged at the dispenser 6. Other couplings providing for appropriate retention of the dispenser to the container may be possible.

The dropper nozzle may further be formed by a component that is separate from the body. In this case the dropper nozzle may have a plug which can be received in the opening of the container, and may protrude through a hole in the body of the dispenser when the device is assembled. Thus different dropper nozzles may be used with similarly designed bodies. This may for example save costs during manufacturing because similar dispensers may be produced at higher volumes relative to dispensers requiring differently configured dropper nozzles.

The dispenser 6 in FIG. 5 is shown in the open position in which the closure 4 opens the outlet 3. The living hinge 18 however allows the closure 4 and the body 5 to be rotated relative to one another toward the closed position. The living hinge 18 of the dispenser 6 may as illustrated be bistable so that the closure 4 and the body 5 are forced toward either the closed or the open position from intermediate positions. The hinge 18 in this and other embodiments may provide for the first rotational axis that is oriented substantially transverse, for example generally perpendicular, relative to the longitudinal axis A' of the dispenser 6. It is noted that a living hinge as shown may not have a fixed rotational axis, but may provide for a rotational axis that moves laterally to the rotational axis as the hinge is moved. The first rotational axis is preferably offset from the longitudinal axis A' of the dispenser (first rotational axis and longitudinal axis do not intersect). The closure 4 may be rotatable by about 180°. Therefore the closure 4 may in the open position be sufficiently moved away from the nozzle so that the closure preferably does not affect precise positioning of the nozzle for dispensing.

The dispenser 6 at the body 5 further has a first retention element 11 and the closure 4 has a second retention element 12. The first and second retention elements 11, 12 are adapted for locking engagement with one another to retain the closure and the dispenser 6 in the closed position. Thus the closure 4 and the body 5 may be locked with each other in the closed position.

Figure 6:
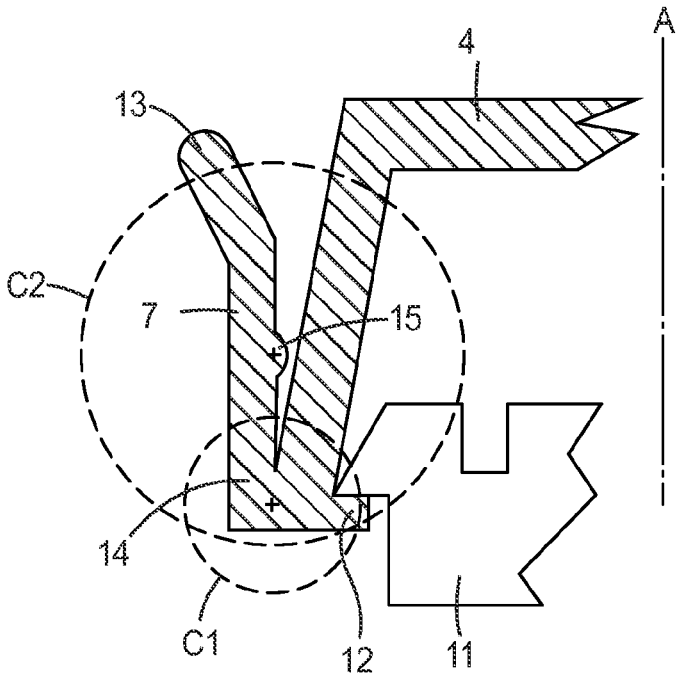
FIG. 6 is a partial cross-sectional view of a closure with a locking member according to an embodiment of the invention.

FIG. 6 shows the locking member 7 and the first retention element 11 in more detail. The locking member 7 has an actuator 13. In the example shown the actuator 13 is formed by a free end of a lever that forms at least a part of the locking member 7. The locking member 7 further is connected to the closure 4, in the example at a connector portion 14 opposite of the actuator. In the configuration shown the locking member is positioned in the lock position. The actuator 13 of the locking member 7 is movable in a direction generally laterally to the longitudinal axis A toward the unlock position. Further the locking member is preferably resiliently maintained in the lock position, in the example by natural material elasticity provided by the connector portion 14. The connector portion 14 in the example forms one part with the closure 4 and the locking member 7. A support 15 may be arranged between the actuator 13 and the connector portion 14. The support 15 is arranged at the locking member 7 and adapted to abut the closure 4 when the locking member 7 is moved toward the unlock position. The skilled person will recognize that the support may likewise be arranged at the closure, or that two cooperating supports may be arranged at the locking member and the closure respectively. Therefore it is further only referred to a support that is arranged at the locking member, although other configurations as mentioned or recognizable for the skilled person shall be included. When the locking member is moved toward the unlock position (in the Figure from the left toward the right) the locking member first pivots about the connector portion 14 until the support 15 touches the closure 4. Therefore the connector portion 14 forms a first pivot for the locking member during an initial stroke of the locking member in which the support is spaced from the closure. When the locking member is moved further toward the unlock position the locking member 7 pivots about the support 15. Therefore the support 15 forms a second pivot for the locking member 7 during a subsequent stroke in which the support 15 abuts the closure 4.

Therefore the locking member is preferably adapted to sequentially pivot about the first and the second pivots during an actuation of the locking member 7 for unlocking the closure (not shown in this Figure). This preferably allows for the locking member 7 to move the second retention element 12 at different paths during the initial stroke and the subsequent stroke. For example in the subsequent stroke the retention element 12 may move on a relatively large circle C2 around the support 15. This preferably provides for sufficient lateral displacement between the first and second retention elements for unlocking the closure and the body. Further in the initial stroke the retention element 12 may move on a relatively small circle C1 around the connector portion 14. This may provide for displacement of the first retention element away from the second retention element in mainly the longitudinal direction of the device. Thus during the initial stroke a pretension between the closure and the body may be relieved before the retention elements are mainly displaced laterally to the longitudinal axis in the subsequent stroke. This may reduce the actuation force needed for unlocking the closure and the container, and thus may make actuation of the locking member relatively convenient.

Figure 7:
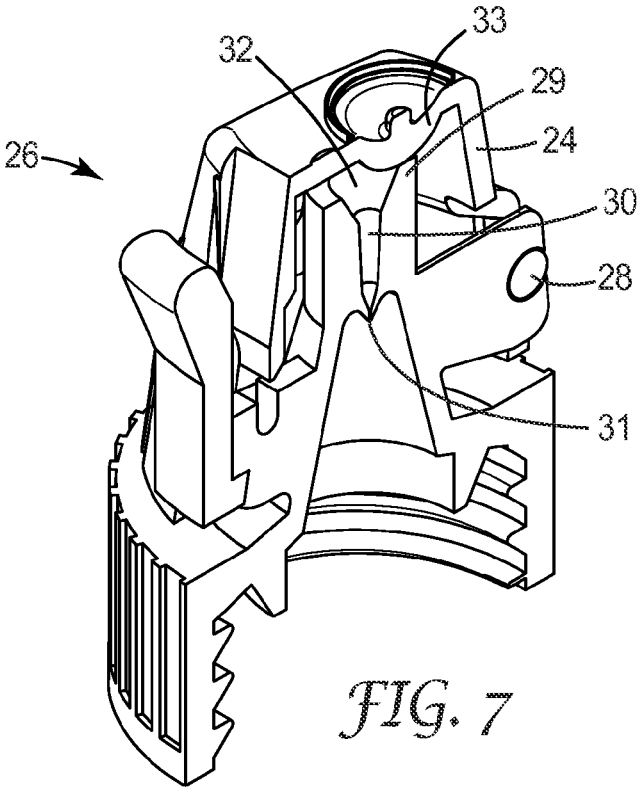
FIG. 7 is a perspective view of another dispenser in a closed position according to an embodiment of the invention.
Figure 8:
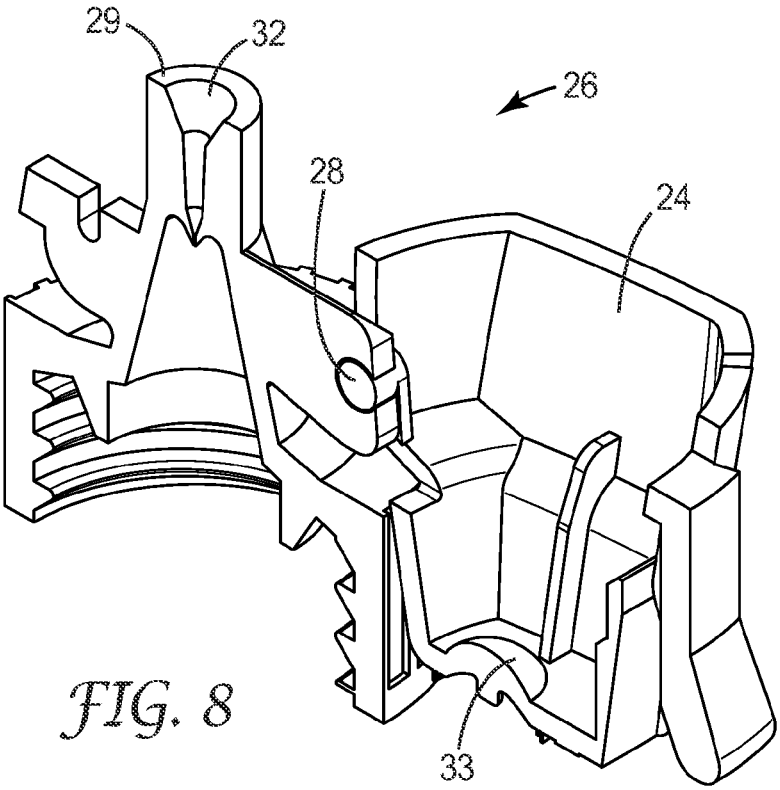
FIG. 8 is a perspective view of the dispenser shown in FIG. 6 in an open position according to an embodiment of the invention.

FIG. 7 and FIG. 8 show cross-sectional views of a dispenser 26 with a closure 24 at the closed position and the open position, respectively. The dispenser 26 and the closure 24 may generally correspond to the embodiments shown in FIGS. 1 to 6, however the dispenser 26 and the closure 24 of the example are two pieces that are interconnected by an assembled hinge 28. The dispenser has a thread for mating with a corresponding thread of the container (not shown). Other structures allowing for retaining the dispenser to a container may be possible though.

FIGS. 7 and 8 further show the dropper nozzle 29, as it may be likewise used in the embodiments of FIGS. 1 to 6, in more detail. The dropper nozzle 29 has a passageway 30 in which an aperture 31 is provided. The aperture preferably forms a constriction in the passageway which restricts the flow of a material to be dispensed, for example a liquid, urged from the container through the nozzle. Thereby a precise and controlled dispensing may be achieved. The passageway 30 may further have a mouth 32. The mouth 32 is preferably adapted to receive a protrusion 33 of the closure for sealing the passageway 30. In the example the protrusion forms a bulge which covers the mouth 32 in the closed position of the closure 4 and the container. The skilled person will recognize that other structures may be used for sealing the nozzle, like for example a pin, a plug, or a flat surface inside the closure on a protrusion or instead of a protrusion. Further a soft sealing member (for example made of rubber, silicone or thermoplastic elastomer) may be arranged inside the closure which in the closed position is pressed between the nozzle and the closure to seal the outlet or mouth 32.

The dispenser and the closure may be molded of a plastic material selected from among Polypropylene (PP), Polyethylene (PE), Polyoxymethylen (POM), Polybutylene-terephtalate (PBT), Acrylonitrile butadien styrene (ABS), Polyamide (PA). PP may be particularly advantageous because it may be available at properties providing for a high durability of the hinge but also for a sufficient mechanical stability of the dispenser and the closure.

A container may have a filling volume of up to 10 ml, preferably a filling volume of between about 2 ml and 8 ml.

The invention claimed is:

1. A dispenser comprising:

a longitudinal axis;

a body with an outlet; and a closure for the outlet;

the closure being pivotally interconnected at the body by a first pivotal interconnection such that the closure is movable relative to the body between an open position in which the outlet is open and a closed position in which the closure closes the outlet;

the closure and the body being further adapted for locking engagement with each other in the closed position;

the closure having a locking member that is movable relative to the closure between a lock position allowing for locking the closure with the body in the closed position, and an unlock position providing for unlocking the closure for movement from the closed position toward the open position;

the locking member having an actuator for moving the locking member between the lock position and the unlock position;

the actuator being movable with respect to the closure in a direction oriented generally laterally to the longitudinal axis;

the actuator and the body being arranged relative to the first pivotal interconnection such that a force applied on the actuator relative to the body for moving the locking member toward the unlock position also urges the closure toward the open position, wherein the locking member is connected to the closure at a connection portion opposite the actuator;

further comprising a support located along the locking member between the actuator and the connection portion, wherein the support is in contact with the closure as the closure is moved between the open position and the closed position.

2. The dispenser of claim 1, wherein the actuator of the locking member extends no further longitudinally than the closure.

3. The dispenser of claim 1, wherein the actuator of the locking member does not extend beyond a top of the closure when the closure is in the closed position.

4. The dispenser of claim 1, wherein the actuator includes a surface that is substantially coplanar with a surface of the closure.

5. The dispenser of claim 1, wherein the actuator is formed of a free end of a lever, and the free end of the lever is movable with respect to the closure in a direction generally laterally to the longitudinal axis.

6. The dispenser of claim 5, wherein the free end of the lever extends no further longitudinally than the closure.

7. The dispenser of claim 1, wherein the locking member includes a free first end comprising the actuator and an opposite second end which is connected with the closure.

8. The dispenser of claim 7, further comprising a support located along the locking member between the free first end and the second end.

9. The dispenser of claim 7, wherein the free first end of the locking member extends no further longitudinally than the closure.

10. The dispenser of claim 7, wherein the free first end includes a surface that is substantially coplanar with a surface of the closure.

11. The dispenser of claim 7, wherein the locking member extends from the second end to the free first end in a direction generally parallel to the longitudinal axis toward a top of the closure when the closure is in the closed position.

12. The dispenser of claim 11, wherein the free first end extends no further longitudinally than the top of the closure.

13. The dispenser of claim 1, wherein the locking member extends generally parallel to the longitudinal axis from the connection portion to the actuator.

14. The dispenser of claim 1, wherein the connection portion forms a first pivot for the locking member, the first pivot positioned to allow the actuator to move with respect to the closure in the direction oriented generally laterally to the longitudinal axis.

15. The dispenser of claim 1, wherein the body forms a bottle and the bottle comprises a light filter.

16. The dispenser of claim 1, wherein the body comprises a material to be dispensed, and wherein the material is a dental adhesive.

17. The dispenser of claim 1, wherein the first pivotal interconnection is provided by a hinge, and wherein the hinge is a bistable hinge.

18. The dispenser of claim 1, wherein the first pivotal interconnection is provided by a hinge, and wherein the hinge is adapted to automatically urge the body and the closure from an intermediate position between the open and closed position toward the open or closed position.

19. The dispenser of claim 1, wherein the first pivotal interconnection is provided by a hinge, and wherein the hinge is formed by a living hinge forming one piece with the closure and the body.

20. The dispenser of claim 1, wherein the closure is rotatable about the first pivotal interconnection between the closed position and the open position by about 180 degrees.

21. The dispenser of claim 1, wherein the locking member has a first retainer and the body has a second retainer, wherein the first and second retainers are adapted for engagement with each other for locking the closure and the body in the closed position.

22. The dispenser of claim 1, wherein the locking member is pivotally connected to the closure to form a second pivotal connection, wherein the second pivotal connection forms a first pivot for the locking member.

23. The dispenser of claim 1, wherein the locking member extends generally parallel to the longitudinal axis.

* * * * *